US007070432B1

(12) United States Patent
Lin

(10) Patent No.: US 7,070,432 B1
(45) Date of Patent: Jul. 4, 2006

(54) SAFETY SOCKET DEVICE

(76) Inventor: Chih Chen Lin, 4F, No. 39, Lane 35, Wuguang Road, Wuguang Tsuen, Wutz Hsiang, Taichung Hsien 41470 (TW)

( * ) Notice: Subject to any disclaimer, the term of this patent is extended or adjusted under 35 U.S.C. 154(b) by 0 days.

(21) Appl. No.: 11/141,967

(22) Filed: Jun. 1, 2005

(51) Int. Cl.
*H01R 29/00* (2006.01)

(52) U.S. Cl. ..... 439/188; 200/51.09

(58) Field of Classification Search ..... 439/188, 439/137; 200/51.09, 51.1
See application file for complete search history.

(56) References Cited

U.S. PATENT DOCUMENTS

| | | | | |
|---|---|---|---|---|
| 4,632,479 | A | 12/1986 | Jacobson | 339/36 |
| 5,026,299 | A | 6/1991 | Foulk | 439/137 |
| 5,069,630 | A | 12/1991 | Tseng et al. | 439/137 |
| 5,306,157 | A * | 4/1994 | Francisco | 439/52 |
| 5,791,931 | A * | 8/1998 | Burkhart, Sr. | 439/346 |
| 5,795,168 | A * | 8/1998 | Duhe | 439/188 |
| 5,915,981 | A * | 6/1999 | Mehta | 439/137 |
| 6,079,995 | A * | 6/2000 | Duhe, Jr. | 439/188 |
| 6,229,107 | B1 * | 5/2001 | Flint et al. | 200/51.09 |
| 6,332,794 | B1 * | 12/2001 | Tzeng Jeng | 439/188 |
| 6,455,789 | B1 * | 9/2002 | Allison | 200/51.09 |
| 6,749,449 | B1 * | 6/2004 | Mortun et al. | 439/188 |
| 2004/0038572 | A1 * | 2/2004 | Liu | 439/172 |

* cited by examiner

*Primary Examiner*—Tulsidas C. Patel
*Assistant Examiner*—Phuongchi Nguyen
(74) *Attorney, Agent, or Firm*—Charles E. Baxley

(57) ABSTRACT

A safety socket device includes a base having two conductor bars, and two female contact strips for receiving prongs of plugs. A conductor member and a conductor element are disposed between the conductor bars and each includes two switches located on the sides of the female contact strips, for selectively and electrically coupling to the conductor bars and the female contact strips together. The female contact strips may be electrically coupled to the conductor bars only when the four switches are actuated by the prongs of the plug simultaneously, to prevent the insertion of foreign objects into the safety socket device by infants and small children.

10 Claims, 8 Drawing Sheets

SAFETY SOCKET DEVICE

BACKGROUND OF THE INVENTION

1. Field of the Invention

The present invention relates to a safety socket device, and more particularly to a safety socket device having a safety structure for preventing the insertion of foreign objects into the safety socket device by infants and small children.

2. Description of the Prior Art

Typical safety socket devices comprise one or more pairs of internal female contact strips which are normally spaced apart longitudinally on a socket body, and contact slots for each female contact strip spread apart transversely of the socket body. Some of the typical safety socket devices comprise electrically non-conductive safety guards having prong-passing openings formed therein and selectively aligned with passageways of the socket body.

For example, when the prong-passing openings of the electrically non-conductive safety guards are aligned with the passageways of the socket body, the prongs of the plugs may be engaged through the passageways of the socket body and may be engaged with the internal female contact strips. On the contrary, when the prong-passing openings of the electrically non-conductive safety guards are offset or are not aligned with the passageways of the socket body, the prongs of the plugs or other objects may not be engaged through the passageways of the socket body and may not be engaged with the internal female contact strips.

For example, U.S. Pat. No. 4,632,479 to Jacobson discloses one of the typical safety socket devices and also comprising electrically non-conductive safety guards for selectively blocking the passageways of the socket body, and for preventing objects from being engaged through the passageways of the socket body and from being engaged with the internal female contact strips. However, children may also have some chances to engage various objects through the passageways of the socket body and to engage with the internal female contact strips inadvertently when the passageways of the socket body are not blocked by the non-conductive safety guards.

U.S. Pat. No. 5,026,299 to Foulk discloses a typical child resistant electrical outlet for preventing the insertion of foreign objects into the safety socket device by infants and small children. The typical child resistant electrical outlet includes internal blocking members movable into open position and closed position respectively. However, similarly, the socket device may also have some chances to engage various objects through into the socket body and to engage with the internal female contact strips of the socket device inadvertently when the socket body is not blocked by the blocking members.

U.S. Pat. No. 5,069,630 to Tseng et al. discloses a typical socket assembly for electrical plugs, and comprising a number of sliding plates spaced from one another and arranged in a row between a base and a cover, for selectively blocking the passageways of the socket device. However, similarly, the socket device may also have some chances to engage various objects through into the socket body and to engage with the internal female contact strips of the socket device inadvertently when the socket body is not blocked by the sliding plates.

The present invention has arisen to mitigate and/or obviate the afore-described disadvantages of the conventional safety socket devices.

SUMMARY OF THE INVENTION

The primary objective of the present invention is to provide a safety socket device including a safety structure for preventing the insertion of foreign objects into the safety socket device by infants and small children.

In accordance with one aspect of the invention, there is provided a safety socket device comprising a base including a first conductor bar and a second conductor bar disposed thereon and spaced away from each other, a first female contact strip and a second female contact strip supported on the base for receiving prongs of a plug, and each including a first side and a second side, a conductor member disposed between the first and the second conductor bars, and including a first switch and a second switch provided thereon and located on the second side of the first female contact strip and the first side of the second female contact strip respectively, for selectively and electrically coupling to the first conductor bar and the second female contact strip respectively, and a conductor element disposed between the first and the second conductor bars, and including a third switch and a fourth switch provided thereon and located on the first side of the first female contact strip and the second side of the second female contact strip respectively, for selectively and electrically coupling to the second conductor bar and the first female contact strip respectively. The first and the second female contact strips are electrically coupled to the first and the second conductor bars respectively only when the first and the second and the third and the fourth switches are actuated by the prongs of the plug simultaneously, to prevent the insertion of foreign objects into the safety socket device by infants and small children.

The first switch includes an end segment extended from the conductor member, and a conductor limb secured onto the first conductor bar and having a limb segment extended therefrom, and located beside the second side of the first female contact strip, for selectively engaging with the end segment of the conductor member. The first switch includes a non-conductive pad attached onto the limb segment of the conductor limb, for engaging with the prongs of the plug, and for preventing the limb segment of the conductor limb from electrically contacting with the prongs of the plug.

The second switch includes an end segment extended from the conductor member, and a blade segment extended from the second female contact strip and located beside the first side of the second female contact strip, for selectively engaging with the end segment of the conductor member. The second switch includes a conductor panel attached onto the blade segment of the second internal female contact strip, for selectively and electrically engaging with the prongs of the plug.

The third switch includes an end segment extended from the conductor element, and a conductor limb secured onto the second conductor bar and having a limb segment extended therefrom, and located beside the second side of the second female contact strip, for selectively engaging with the end segment of the conductor element. The third switch includes a non-conductive pad attached onto the limb segment of the conductor limb, for engaging with the prongs of the plug, and for preventing the limb segment of the conductor limb from electrically contacting with the prongs of the plug.

The first and the second conductor bars each includes an extension extended therefrom. One or more electric wires may further be provided and electrically coupled to the first and the second conductor bars respectively. A non-conductive plate may further be provided and engaged onto the conductor bars, the conductor member is preferably disposed below the non-conductive plate, and the conductor element is preferably disposed above the non-conductive plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
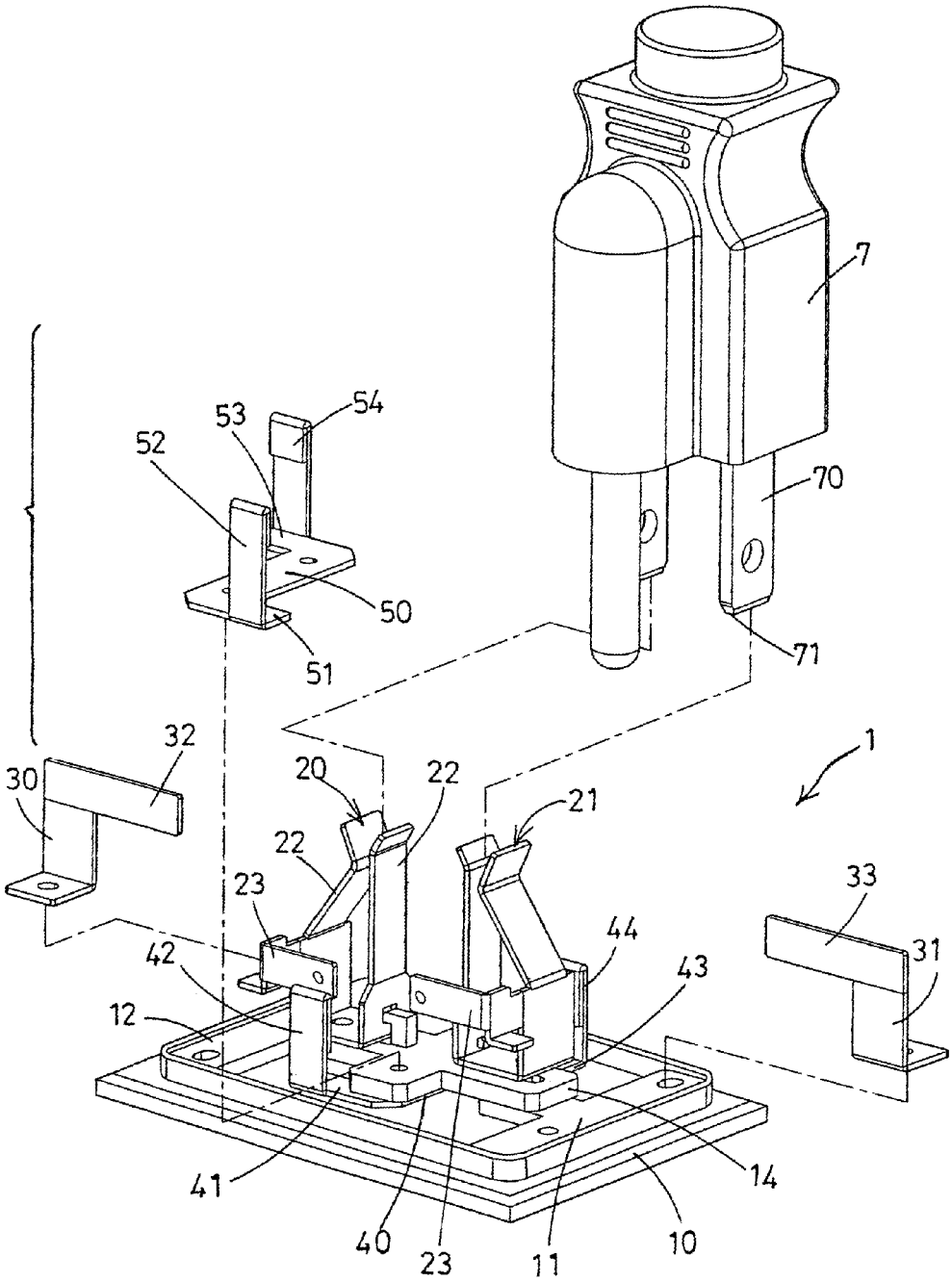
FIG. 1 is a partial exploded view of a safety socket device in accordance with the present invention.
Figure 2:
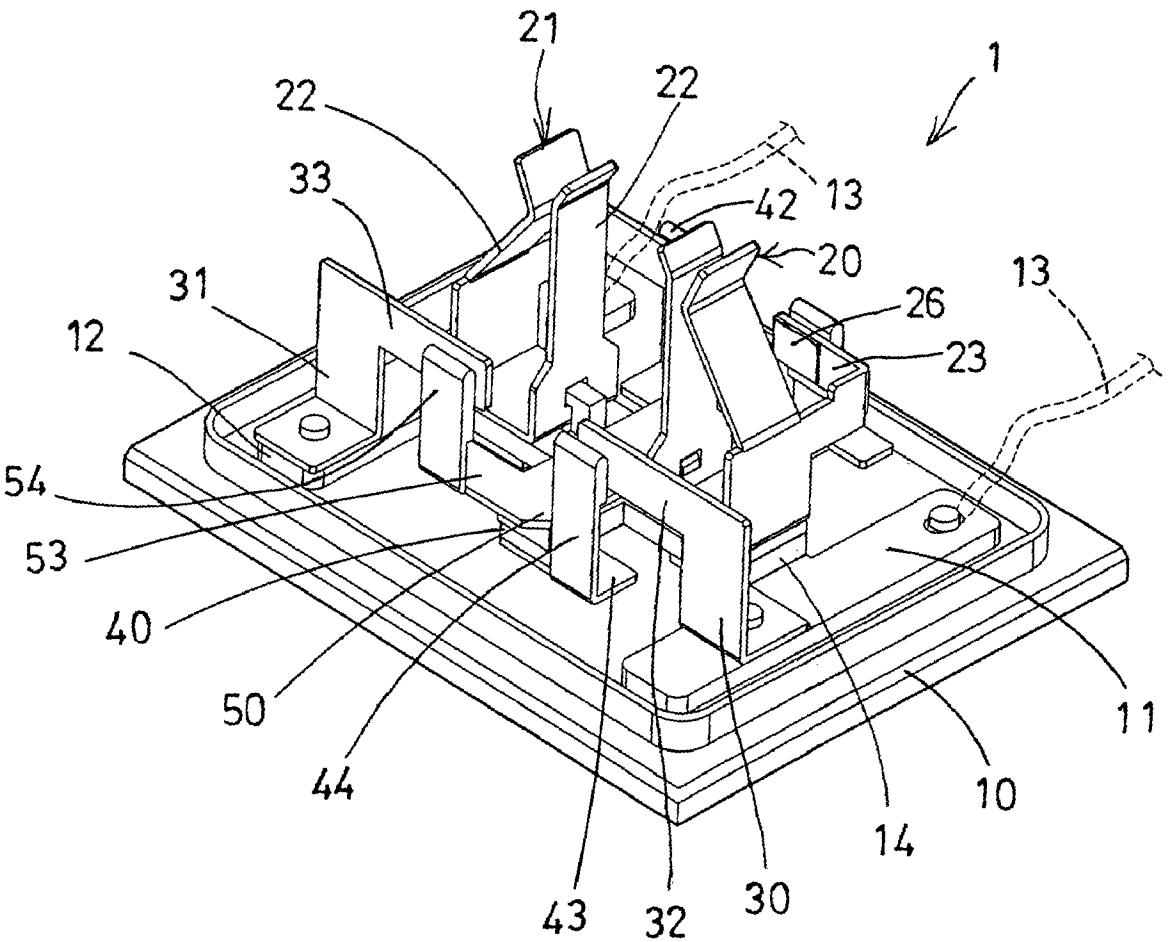
FIG. 2 is a partial perspective view of the safety socket device, as seen from an opposite direction from that shown in FIG. 1, in which an outer cover has been removed for showing an inner structure of the safety socket device.
Figure 3:
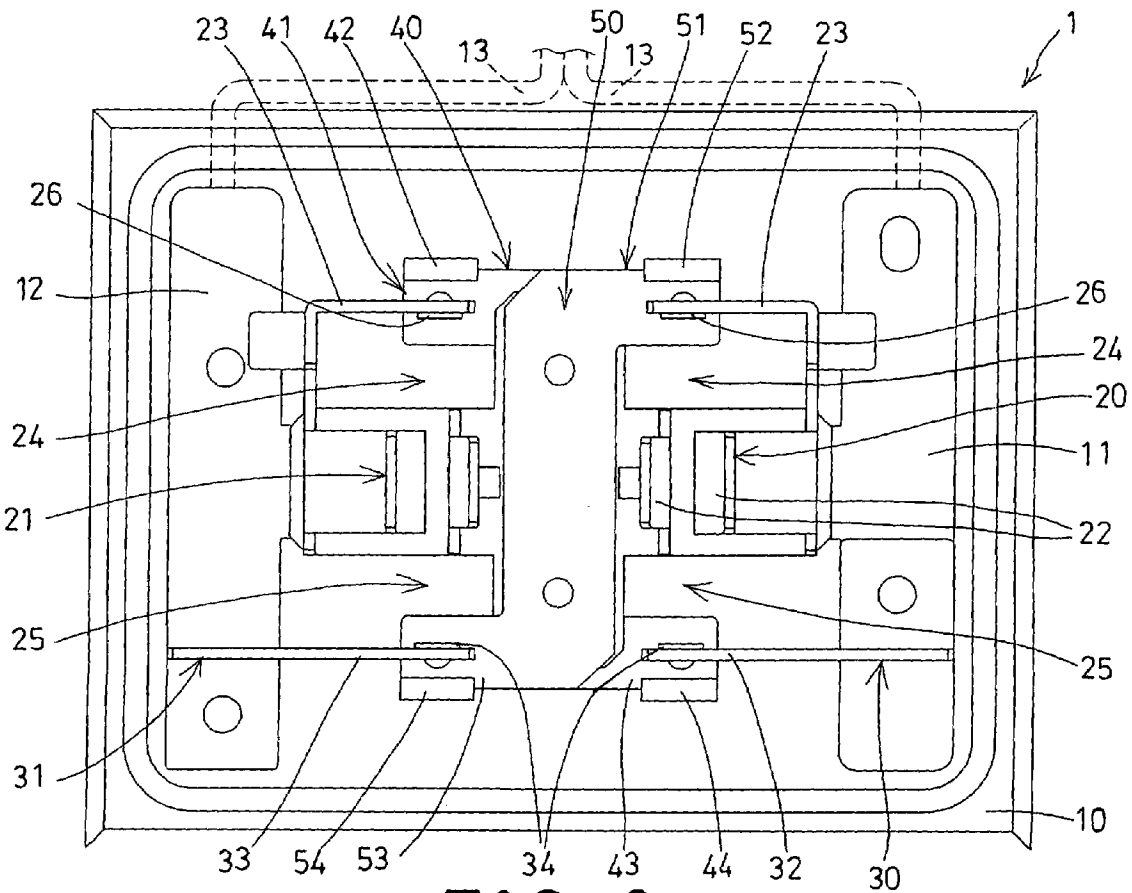
FIG. 3 is a top plan schematic view of the safety socket device, in which the outer cover has also been removed for showing the inner structure of the safety socket device.

Referring to the drawings, and initially to FIGS. 1–3, a safety socket device 1 in accordance with the present invention comprises a base 10, and two conductor bars 11, 12 disposed on the base 10 and spaced away from each other and each coupled to an electric wire 13 respectively. A non-conductive or electrically insulating plate 14 is disposed and engaged onto the conductor bars 11, 12, and the insulating plate 14 will not electrically couple the conductor bars 11, 12 together.

Figure 4:
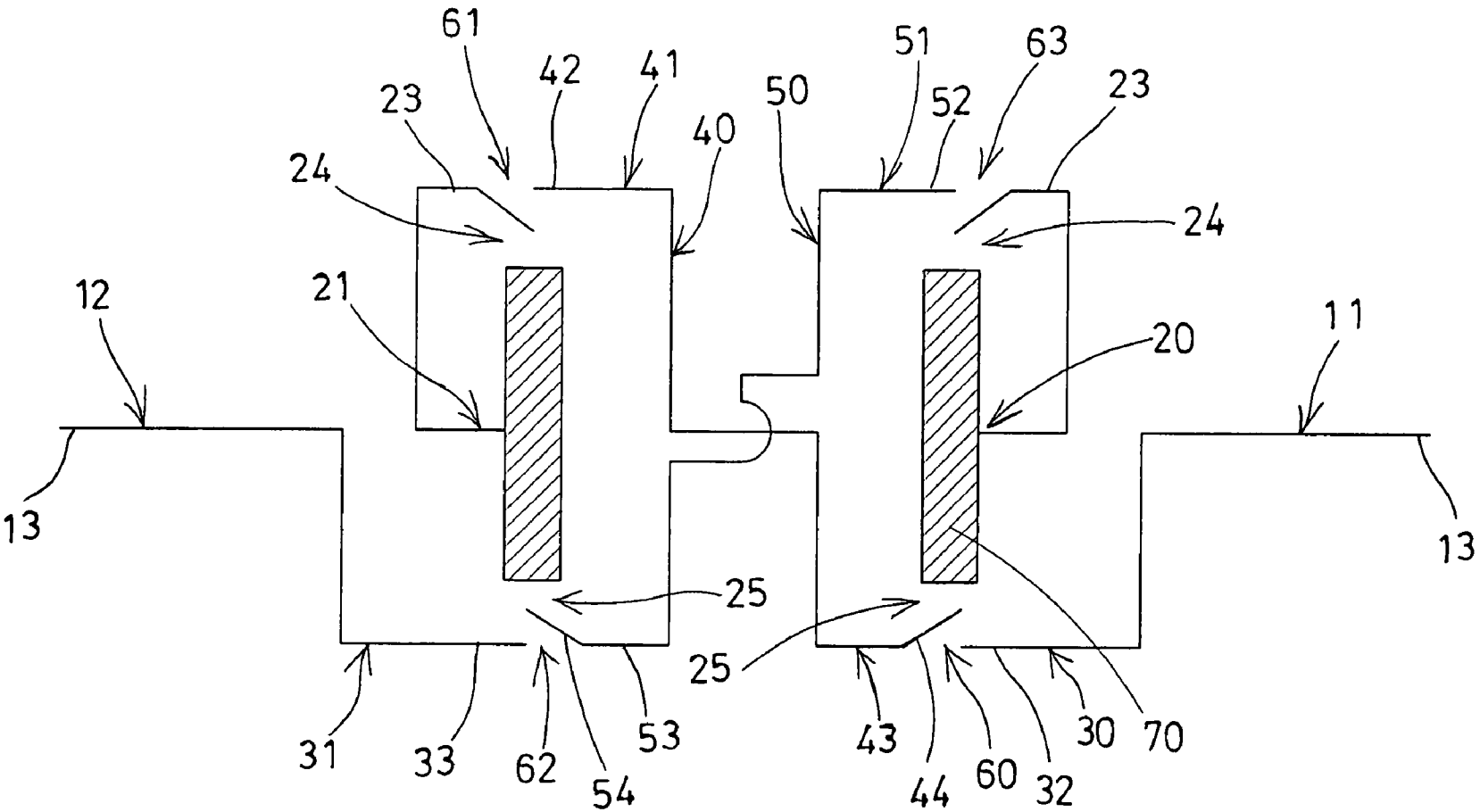
FIG. 4 is a plan schematic view illustrating an electric circuit of the safety socket device.

Two or more, or one or more pairs of internal female contact strips 20, 21 are disposed on the base 10, and disposed or supported on such as the non-conductive or electrically insulating plate 14, and each of the internal female contact strips 20, 21 includes a substantially U-shaped structure formed by two spring blades 22, for receiving and clamping and retaining prongs 70 of plugs 7 (FIGS. 1, 5, 8) between the spring blades 22. One of the spring blades 22 of each female contact strip 20, 21 includes a blade segment 23 extended therefrom and perpendicular to the respective spring blades 22, and extended toward and located on one side or first side 24 of the internal female contact strips 20, 21 respectively (FIGS. 3–5).

Two conductor limbs 30, 31 are secured onto the conductor bars 11, 12 respectively, and thus electrically coupled to the electric wires 13, and each includes a limb segment 32, 33 extended therefrom, and preferably extended to and located beside the other side 25 of the female contact strip 20, 21 respectively. It is preferable that a non-conductive or electrically insulating pad 34 is attached or secured onto each of the limb segments 32, 33 (FIGS. 3, 5–6 and 8), for engaging with the prongs 70 of the plugs 7 (FIGS. 5, 8), and for preventing the limb segments 32, 33 of the conductor limbs 30, 31 from electrically coupling or contacting with the prongs 70 of the plugs 7.

Figure 5:
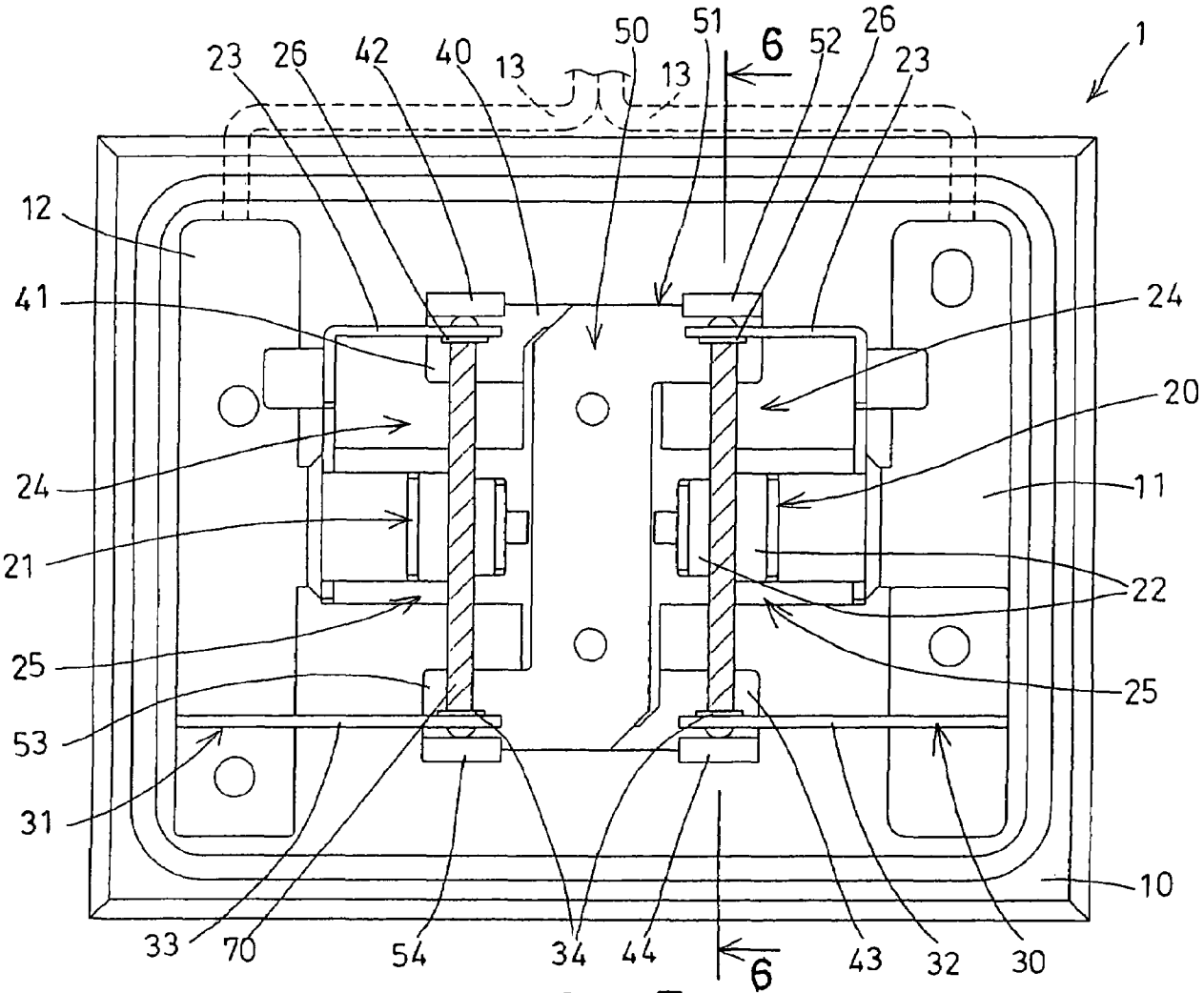
FIG. 5 is a top plan schematic view similar to FIG. 3, illustrating the operation of the safety socket device.

A conductor member 40 is disposed between the conductor bars 11, 12, and below the insulating plate 14, but not electrically coupled to the conductor bars 11, 12, and includes a substantially Z-shaped structure having one end 41 extended to and located beside one side 24 of the second female contact strip 21, and having an end segment 42 extended from the one end 41 thereof, and extended to and located beside the blade segment 23 of the second female contact strip 21, for selectively engaging with or contacting with the blade segment 23 of the second female contact strip 21 (FIG. 5).

The conductor member 40 includes the other end 43 extended to and located beside the other side 25 of the first female contact strip 20, and having an end segment 44 extended from the other end 43 thereof, and located beside the limb segment 32 of the first conductor limb 30, for selectively engaging or contacting with the limb segment 32 of the first conductor limb 30 (FIGS. 5–6, 8), and thus for selectively and electrically coupled to the first conductor bar 11 (FIGS. 3–6 and 8).

Figure 6:
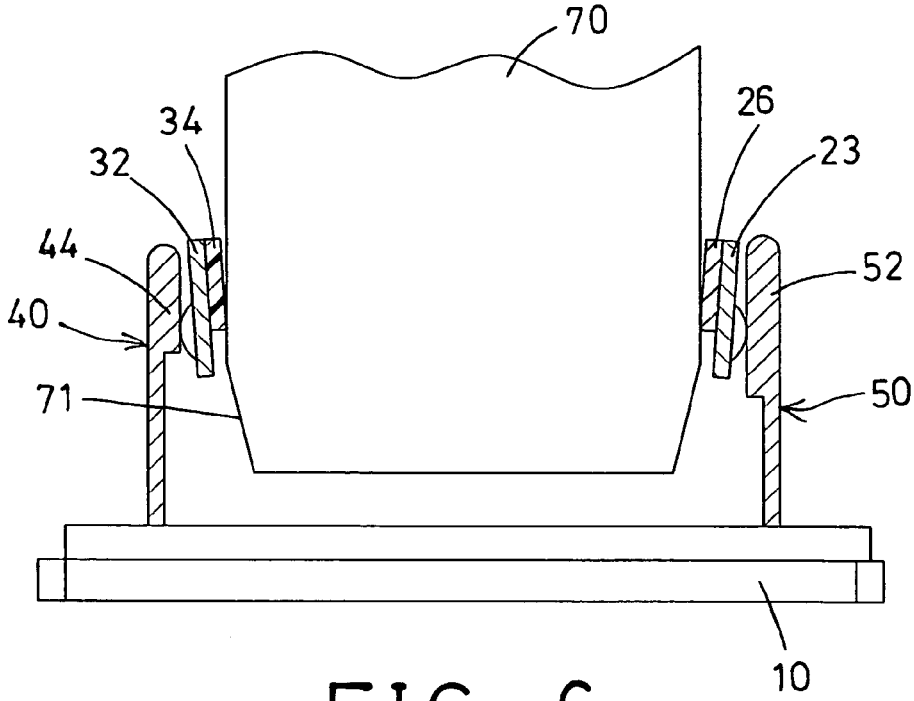
FIG. 6 is a partial cross sectional view of the safety socket device, taken along lines 6-6 of FIG. 5.

A conductor element 50 is also disposed between the conductor bars 11, 12, but above the insulating plate 14, and also not electrically coupled to the conductor bars 11, 12, and also includes a substantially Z-shaped structure having one end 51 extended to and located beside one side 24 of the first female contact strip 20, and having an end segment 52 extended from the one end 51 thereof, and extended to and located beside the blade segment 23 of the first female contact strip 20, for selectively engaging or contacting with the blade segment 23 of the first female contact strip 20 (FIGS. 5, 6).

The conductor member 50 includes the other end 53 extended to and located beside the other side 25 of the second female contact strip 21, and having an end segment 54 extended from the other end 53 thereof, and located beside the limb segment 33 of the second conductor limb 31, for selectively engaging or contacting with the limb segment 32 of the second conductor limb 31 (FIGS. 4–5, 8), and thus for selectively and electrically coupled to the second conductor bar 12 (FIGS. 3–5 and 8).

As shown in FIGS. 3, 5, 6 and 8, it is preferable that a conductor panel 26 is further provided and attached onto the blade segment 23 of each of the internal female contact strips 20, 21 respectively, for electrically engaging with the prongs 70 of the plugs 7, and for facilitating the engagement of the blade segments 23 of the internal female contact strips 20, 21 with the end segments 42, 52 of the conductor member 40 and the conductor element 50 respectively. The non-conductive or electrically insulating pad 34 that is attached or secured onto each of the limb segments 32, 33 of the conductor limbs 30, 31 may also be used for facilitating the engagement of the limb segments 32, 33 of the conductor limbs 30, 31 with the end segments 44, 54 of the conductor member 40 and the conductor element 50 respectively by the prongs 70 of the plugs 7.

Figure 7:
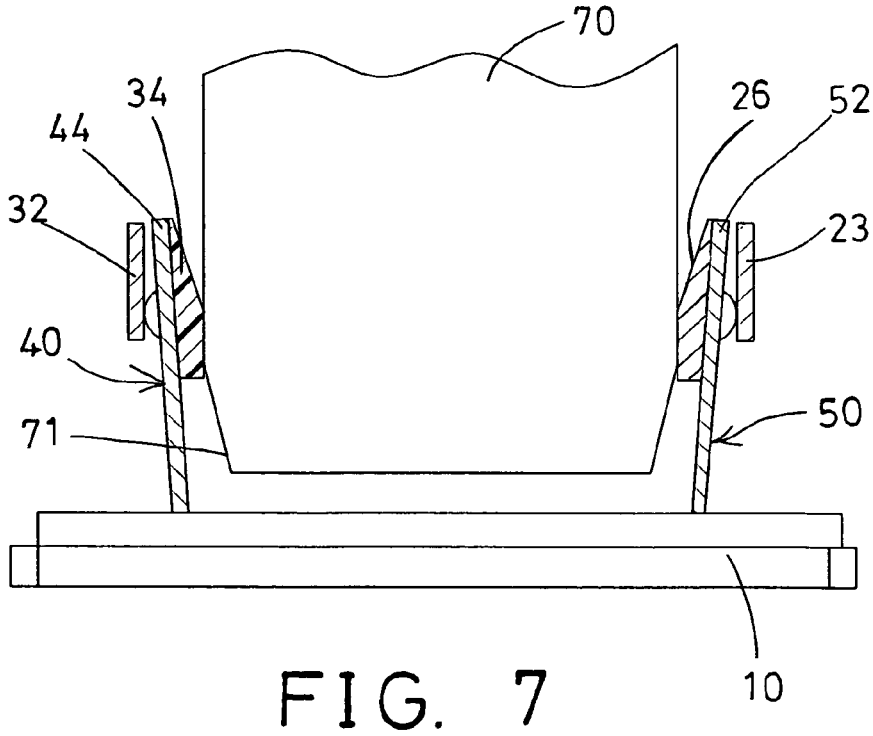
FIG. 7 is a partial cross sectional view similar to FIG. 6, illustrating the other arrangement of the safety socket device.

Alternatively, as shown in FIG. 7, the limb segments 32, 33 of the conductor limbs 30, 31 may be disposed on the other side or the outer side of the end segments 44, 54 of the conductor member 40 and the conductor element 50 respectively, and the non-conductive or electrically insulating pad 34 may be attached or secured onto the end segments 44, 54 of the conductor member 40 and the conductor element 50 respectively, for engaging with the prongs 70 of the plugs 7, and thus for facilitating the engagement of the end segments 44, 54 of the conductor member 40 and the conductor element 50 with the limb segments 32, 33 of the conductor limbs 30, 31 respectively.

Similarly, the blade segments 23 of the internal female contact strips 20, 21 may also be disposed on the other side or the outer side of the end segments 42, 52 of the conductor member 40 and the conductor element 50 respectively, and the conductor panels 26 may be attached onto the end segments 42, 52 of the conductor member 40 and the conductor element 50 respectively, and thus for facilitating the engagement or electrically contacting of the end segments 42, 52 of the conductor member 40 and the conductor element 50 with the blade segments 23 of the internal female contact strips 20, 21 respectively.

As shown in FIGS. 1 and 6–7, normally, the prongs 70 of the plugs 7 may include inclined or rounded or tapered surfaces 71 formed in bottom thereof, for forcing the blade segments 23 of the internal female contact strips 20, 21 and the limb segments 32, 33 of the conductor limbs 30, 31 to engage with the end segments 42, 52 and 44, 54 of the conductor member 40 and the conductor element 50 respectively.

As shown in FIG. 4, the conductor member 40 may thus be used for selectively and electrically coupling the first conductor bar 11 to one of the prongs 70 of the plug 7 via the second female contact strip 21. The limb segment 32 of the first conductor limb 30 and the end segments 44 of the conductor member 40 may thus form a switch 60, and the blade segment 23 of the second internal female contact strip 21 and the end segments 42 of the conductor member 40 may thus form another switch 61. The switches 60, 61 may thus be formed and provided between the first conductor bar 11 and the second female contact strip 21, and may be formed and provided on two ends 41, 43 of the conductor member 40.

Similarly, the conductor element 50 may thus be used for selectively and electrically coupling the second conductor bar 11 to the other prong 70 of the plug 7 via the first female contact strip 20. The limb segment 33 of the second conductor limb 31 and the end segments 54 of the conductor element 50 may thus form a switch 62, and the blade segment 23 of the first internal female contact strip 20 and the end segments 52 of the conductor element 50 may thus form another switch 63. The switches 62, 63 may thus be formed and provided between the second conductor bar 12 and the first female contact strip 20, and may be formed and provided on two ends 51, 53 of the conductor element 50.

Figure 10:
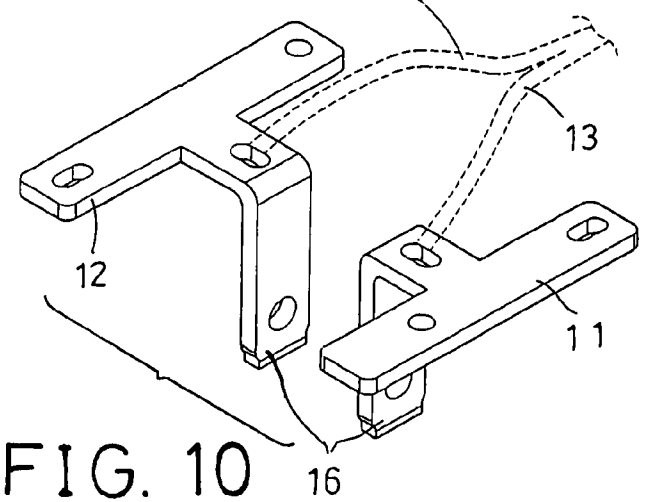
FIG. 10 is a further partial exploded view illustrating the other arrangement of the conductor bars of the safety socket device.
Figure 9:
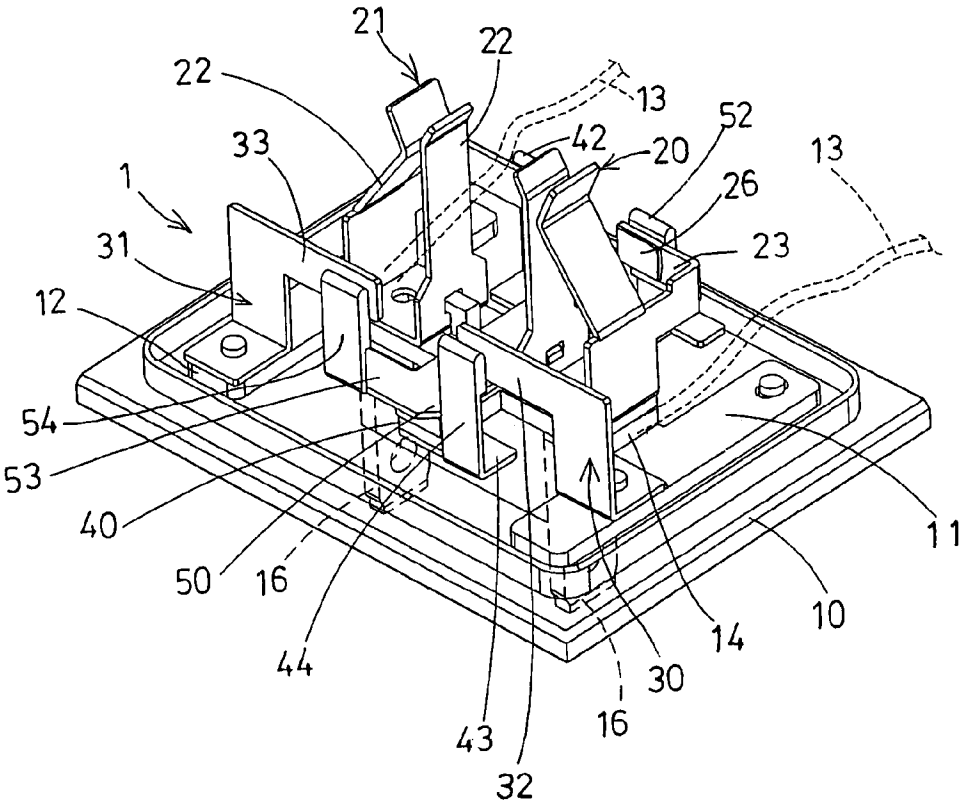
FIG. 9 is another partial exploded view illustrating the further arrangement of the safety socket device.

In operation, as shown in FIGS. 4 and 5, the prongs 70 of the plug 7 may be electrically coupled to the conductor bars 11, 12 respectively only when the prongs 70 of the right sizes or width are engaged into the female contact strips 20, 21 respectively, and only when all of the four switches 60–63 are closed or actuated by the prongs 70. As shown in FIGS. 9 and 10, the conductor bars 11, 12 may each include an extension 16 extended therefrom, and extended out of the base 10, for electrically coupling to the other electric facilities (not shown).

Figure 8:
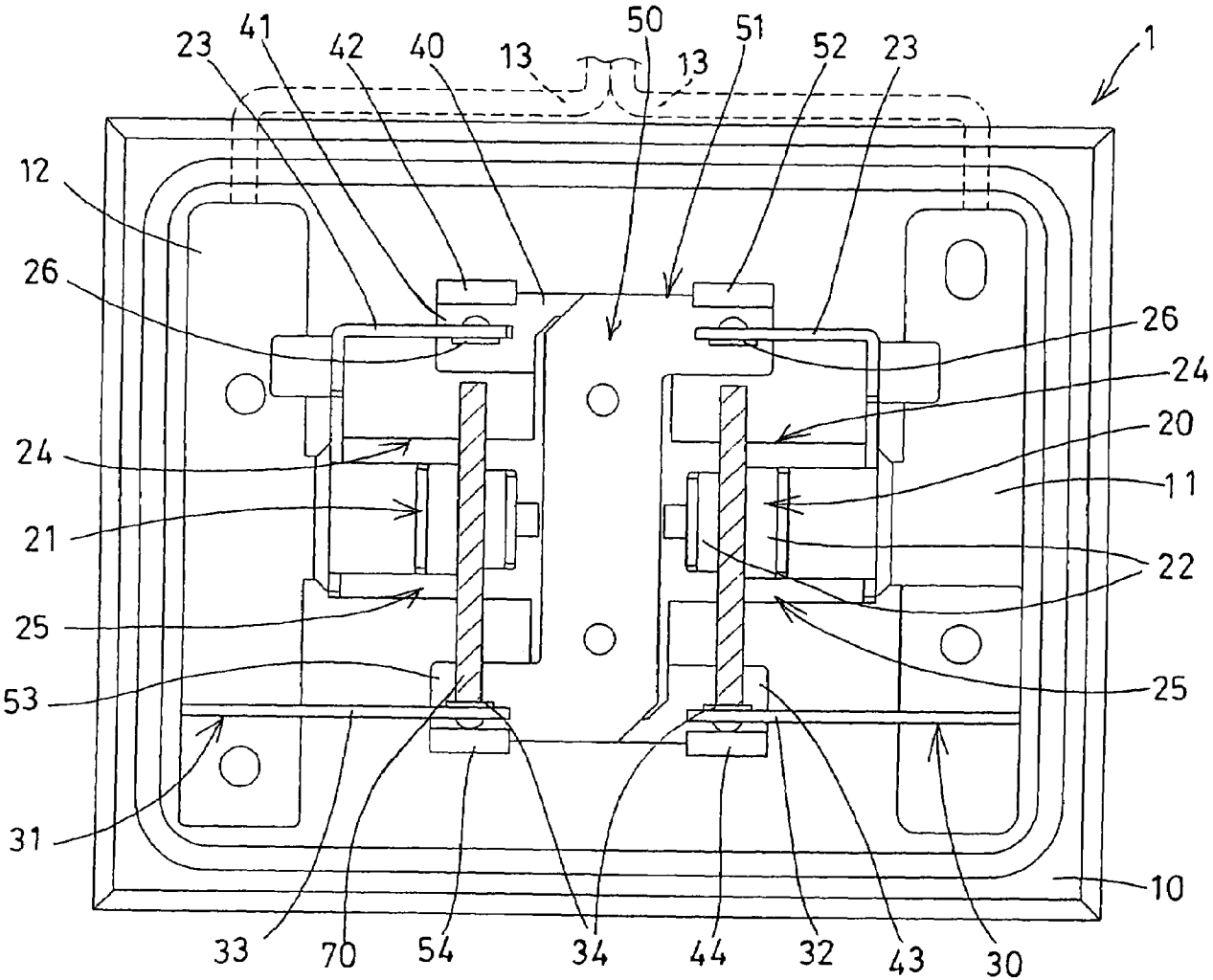
FIG. 8 is a top plan schematic view similar to FIGS. 3 and 5, illustrating the operation of the safety socket device.

As shown in FIG. 8, when the prongs 70 of different or of incorrect sizes or width or other objects are engaged into the female contact strips 20, 21 inadvertently by such as children, only one or two of the switches 60, 62 may be closed or actuated by the prongs 70. At this moment, the prongs 70 of the plug 7 will not and may not be electrically coupled to the conductor bars 11, 12 respectively.

Accordingly, the safety socket device in accordance with the present invention includes a safety structure for preventing the insertion of foreign objects into the safety socket device by infants and small children.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A safety socket device comprising:

a base including a first conductor bar and a second conductor bar disposed thereon and spaced away from each other, a first female contact strip and a second female contact strip supported on said base for receiving prongs of a plug, and each including a first side and a second side, a conductor member disposed between said first and said second conductor bars, and including a first switch and a second switch provided thereon and located on said second side of said first female contact strip and said first side of said second female contact strip respectively, for selectively and electrically coupling to said first conductor bar and said second female contact strip respectively, and a conductor element disposed between said first and said second conductor bars, and including a third switch and a fourth switch provided thereon and located on said first side of said first female contact strip and said second side of said second female contact strip respectively, for selectively and electrically coupling to said second conductor bar and said first female contact strip respectively, and said first and said second female contact strips being electrically coupled to said first and said second conductor bars respectively only when said first and said second and said third and said fourth switches are actuated by the prongs of the plug simultaneously.

2. The safety socket device as claimed in claim 1, wherein said first and said second conductor bars each includes an extension extended therefrom.

3. The safety socket device as claimed in claim 1 further comprising electric wires electrically coupled to said first and said second conductor bars respectively.

4. The safety socket device as claimed in claim 1 further comprising a non-conductive plate engaged onto said first and said second conductor bars, said conductor member being disposed below said non-conductive plate, and said conductor element being disposed above said non-conductive plate.

5. The safety socket device as claimed in claim 1, wherein said first switch includes an end segment extended from said conductor member, and a conductor limb secured onto said first conductor bar and having a limb segment extended therefrom, and located beside said second side of said first female contact strip, for selectively engaging with said end segment of said conductor member.

6. The safety socket device as claimed in claim 5, wherein said first switch includes a non-conductive pad attached onto said limb segment of said conductor limb, for engaging with the prongs of the plug, and for preventing said limb segment of said conductor limb from electrically contacting with the prongs of the plug.

7. The safety socket device as claimed in claim 1, wherein said second switch includes an end segment extended from said conductor member, and a blade segment extended from said second female contact strip and located beside said first side of said second female contact strip, for selectively engaging with said end segment of said conductor member.

8. The safety socket device as claimed in claim 7, wherein said second switch includes a conductor panel attached onto said blade segment of said second internal female contact strip, for electrically engaging with the prongs of the plug.

9. The safety socket device as claimed in claim 1, wherein said third switch includes an end segment extended from said conductor element, and a conductor limb secured onto said second conductor bar and having a limb segment extended therefrom, and located beside said second side of said second female contact strip, for selectively engaging with said end segment of said conductor element.

10. The safety socket device as claimed in claim 9, wherein said third switch includes a non-conductive pad attached onto said limb segment of said conductor limb, for engaging with the prongs of the plug, and for preventing said limb segment of said conductor limb from electrically contacting with the prongs of the plug.

* * * * *